United States Patent [19]

Fallon, III

[11] 4,245,569

[45] Jan. 20, 1981

[54] SCRUBBER BYPASS SYSTEM

[75] Inventor: George W. Fallon, III, Enfield, Conn.

[73] Assignee: Combustion Engineering, Inc., Windsor, Conn.

[21] Appl. No.: 23,872

[22] Filed: Mar. 26, 1979

[51] Int. Cl.[3] ..... F23J 15/00

[52] U.S. Cl. ..... 110/215; 110/162; 110/345; 266/146; 266/159; 432/72

[58] Field of Search ..... 110/203, 215, 163, 162, 110/344, 345; 432/72, 66; 266/146, 159

[56] References Cited

U.S. PATENT DOCUMENTS

| | | | |
|---|---|---|---|
| 3,884,162 | 5/1975 | Schuster | 110/215 X |
| 4,145,193 | 3/1979 | Hegemann | 266/159 X |
| 4,152,123 | 5/1979 | Hegemann et al. | 266/159 X |

*Primary Examiner*—Edward G. Favors
*Attorney, Agent, or Firm*—William W. Habelt

[57] ABSTRACT

A scrubber bypass damper comprises a plate pivotally-mounted to a shaft running across the bypass duct transverse to gas flow. The damper plate self-actuates and rotates about the shaft in response to any pressure differential established across it. A scrubber booster fan is disposed in the main flue at a location downstream of the scrubber and upstream of the outlet of the scrubber bypass into the main flue. When the scrubber is in operation, the pressure rise imparted to the flue gas by the scrubber booster fan is adjusted to keep the damper plate disposed transverse to gas flow through the bypass duct thereby preventing gas flow therethrough. When the scrubber is taken out-of-service, the booster fan is shutdown and the damper plate self-actuates, opening in response to pressure forces exerted on it by the induced draft fan, thus preventing over-pressurization of the furnace.

6 Claims, 4 Drawing Figures

SCRUBBER BYPASS SYSTEM

BACKGROUND OF THE INVENTION

This invention relates to steam generators equipped with air pollution control devices and more particularly to an apparatus and method for providing a flow path directly to the stack thereby bypassing the air pollution control equipment.

Air pollution control equipment is being installed on all coal-fired steam generators in order to remove from the flue gas particulate matter and gaseous pollutants such as $SO_2$ which are inherently formed during the combustion process. Frequently, the air pollution control equipment installed includes a gas scrubber disposed downstream of the induced draft fan, said scrubber designed to remove $SO_2$, and often particulate matter also entrained in the flue gas. In operation, the combustion products formed in the furnace, termed flue gas, exit the boiler through an air preheater to an induced draft fan which raises the pressure of the flue gas to a level sufficiently above atmospheric pressure to ensure proper venting of the flue gas through the stack. Upon leaving the induced draft fan, the flue gas, before continuing to the stack, passes through the scrubber wherein the $SO_2$ and particulate matter are removed.

Many coal-fired steam generator furnaces are also designed to fire clean fuel such as natural gas or low sulfur oil which do not produce levels of particulate matter or sulfur oxides high enough to necessitate tail end flue gas cleaning. When these clean fuels are being fired, it is desirable to operate the steam generator without the scrubber in service and provide a flow path, commonly termed a scrubber bypass, for venting the flue gas around the scrubber directly to the stack. However, because of the strict governmental air pollution regulations limiting the emissions of $SO_2$ and particulate matter, the scrubber bypass must be closed off when coal is being fired to ensure that contaminated flue gas does not leak through to the atmosphere when a scrubber is in operation.

A common means for controlling the flow of flue gas through the scrubber bypass is a multi-bladed louver-type scrubber bypass damper placed in the bypass to the stack. This scrubber bypass damper when closed blocks the flow through the bypass thereby forcing the flue gas to flow through the scrubber, and when opened allows the flue gas to bypass the scrubber and flow directly to the stack. An additional multi-bladed louver damper is placed in the inlet to the scrubber and operates in coordination with the scrubber bypass damper, opening when the scrubber bypass damper is closed, i.e., when the scrubber is in operation and closing when the scrubber bypass damper is opened, i.e., when the scrubber is out-of-service.

A major problem associated with this prior art arrangement is the over-pressurization of the furnace which can result if the scrubber bypass damper fails to open when the scrubber inlet damper is closed as the scrubber comes off line. In such a case, both of the flow paths to the stack will be blocked to flue gas flow by their respective closed dampers; the furnace pressure would rise to an unacceptable level causing shutdown and potential damage to the boiler or its support structure. Recognizing this problem, elaborate control systems have been developed and installed in an attempt to provide highly reliable, fail-safe operation of such multi-bladed louver dampers.

SUMMARY OF THE INVENTION

The invention disclosed herein provides a very reliable, self-actuating scrubber bypass which completely eliminates the need for elaborate control systems while still ensuring fail-safe operation.

The invention provided herein relates to a self-actuating bypass damper disposed in the scrubber bypass duct. The scrubber bypass duct opens at its inlet end into the main flue at a location between the induced draft fan and the scrubber inlet damper and at its outlet end into the main flue at a location downstream of the scrubber which is disposed in the main flue between the induced draft fan and the stack. Further, a second fan, termed a scrubber booster fan, is disposed in the main flue at a location downstream of the scrubber and before the outlet of the scrubber bypass into the main flue. Means operatively associated with the second fan are provided for controlling the pressure rise imparted to the flue gas by the second fan.

In accordance with the invention, the bypass damper consists of a plate pivotally-mounted so as to be free to rotate about a shaft running across the bypass duct transverse to gas flow. The plate is sized to provide an essentially gas-tight barrier in the flue gas duct when disposed transversely with respect to gas flow therethrough. The damper self-actuates in response to any pressure differential established across it.

When the scrubber is in operation, the pressure rise imparted by the scrubber booster fan to the flue gas flowing through the scrubber is adjusted to balance the gas pressure in the main flue at the outlet of the scrubber bypass with the gas pressure in the main flue at the inlet of the scrubber bypass. By design, the scrubber bypass damper plate will be disposed transverse to the gas flow through the bypass duct which there is no pressure difference across it, i.e., when the gas pressure in the main flue at the outlet of the scrubber bypass is equal to the gas pressure in the main flue at the inlet of the scrubber bypass, and thereby provide an essentially gas-tight seal in the scrubber bypass and ensure that the flue gas flows through the scrubber.

When the scrubber is brought out-of-service, the scrubber booster fan is shutdown and the scrubber inlet damper closed thereby shutting off flow in the main flue through the scrubber to the stack. With the induced draft fan still in operation and the booster fan shutdown, a pressure differential is established across the scrubber bypass damper. In response to this pressure differential the scrubber bypass damper plate will promptly self-actuate and pivot open thereby providing a flow path to the stack and precluding over-pressurization of the boiler.

DESCRIPTION OF THE PREFERRED EMBODIMENT

Figure 1:
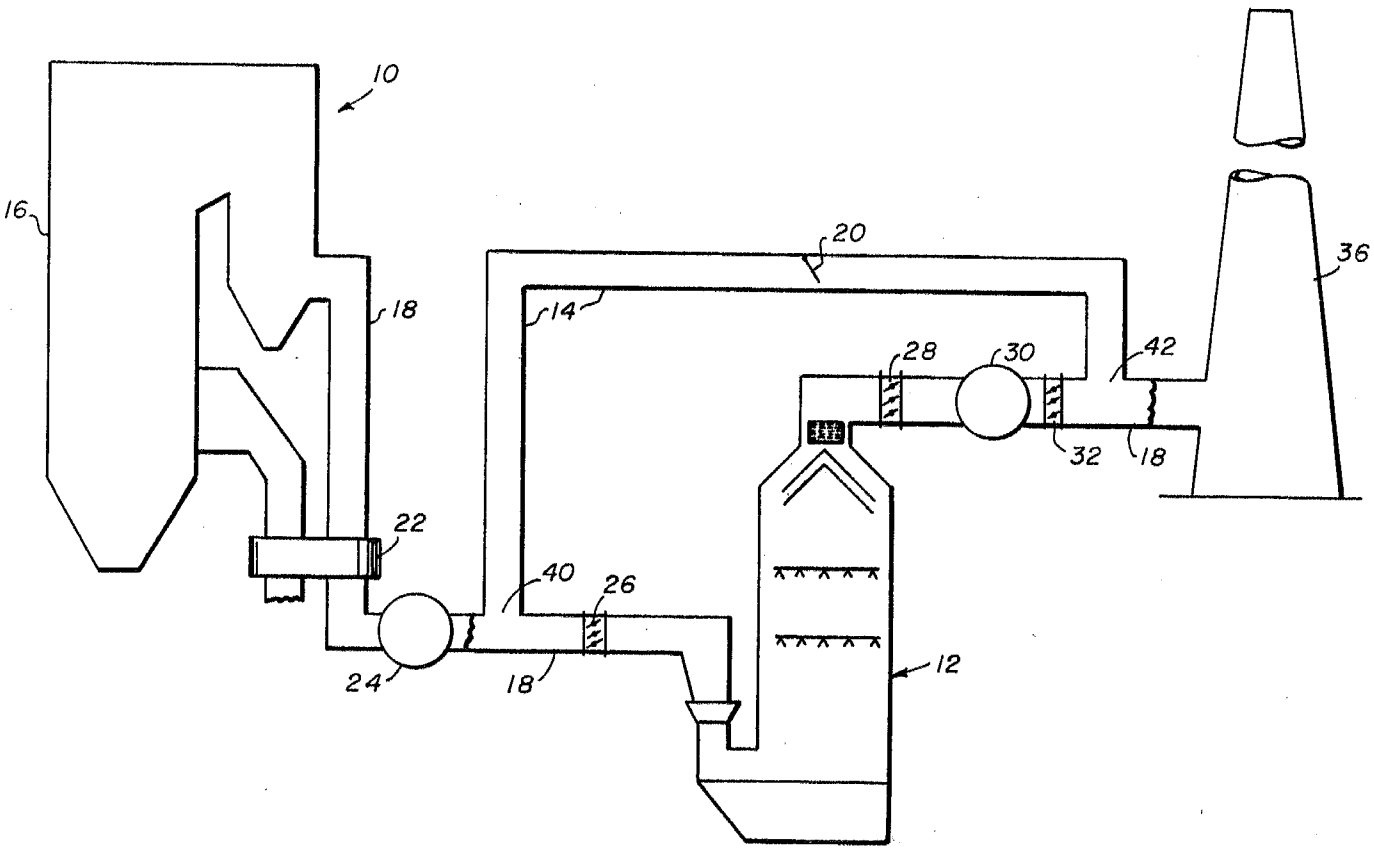
FIG. 1 is a side elevational view, partly in section, of a boiler having a gas scrubber incorporating a scrubber bypass duct designed in accordance with the present invention with the self-actuating bypass damper disposed in a horizontal run of said bypass duct.

FIG. 1 is a side elevation view of a boiler 10 having a gas scrubber 12 incorporating a scrubber bypass duct 14 designed in accordance with the present invention with a self-actuating bypass damper 20 disposed in a horizontal run of the bypass duct 14. During operation, combustion products, termed flue gas, formed in furnace 16 pass into main flue 18 through an air heater 22 and an induced draft fan 24. If the gas scrubber 12 is in use, scrubber inlet damper 26, typically a multi-bladed louver damper, would be opened and the flue gas would flow through the scrubber inlet damper 26 into gas scrubber 12 which is disposed in the main flue 18 at a location between the induced draft fan 24 and stack 36. The flue gas passing into scrubber 12 is cleaned of gaseous pollutants and particulate matter in any well-known manner, including but not limited to wet scrubbing as shown, not forming a part of this invention.

The cleansed flue gas passes from gas scrubber 12 through scrubber outlet damper 28, typically a multi-bladed louver damper, into main flue 18 which communicates with stack 36 for venting the cleansed flue gas to the atmosphere. A second fan 30 termed a scrubber booster fan is disposed in the main flue 18 between the gas scrubber 12 and the stack 36 to increase the static pressure of the flue gas leaving the gas scrubber thereby creating a positive pressure differential between the flue gas and the atmosphere and ensuring proper venting of the flue gas to the atmosphere through stack 36. Operatively associated with scrubber booster fan 30 are means 32 for modulating the pressure rise imparted to the flue gas by the scrubber booster fan 30. Although shown as a multibladed louver damper on the outlet side of booster fan 30, modulating means 32 may comprise any known fan pressure rise control, including but not limited to inlet veins, inlet louver dampers, or variable speed.

Figure 2:
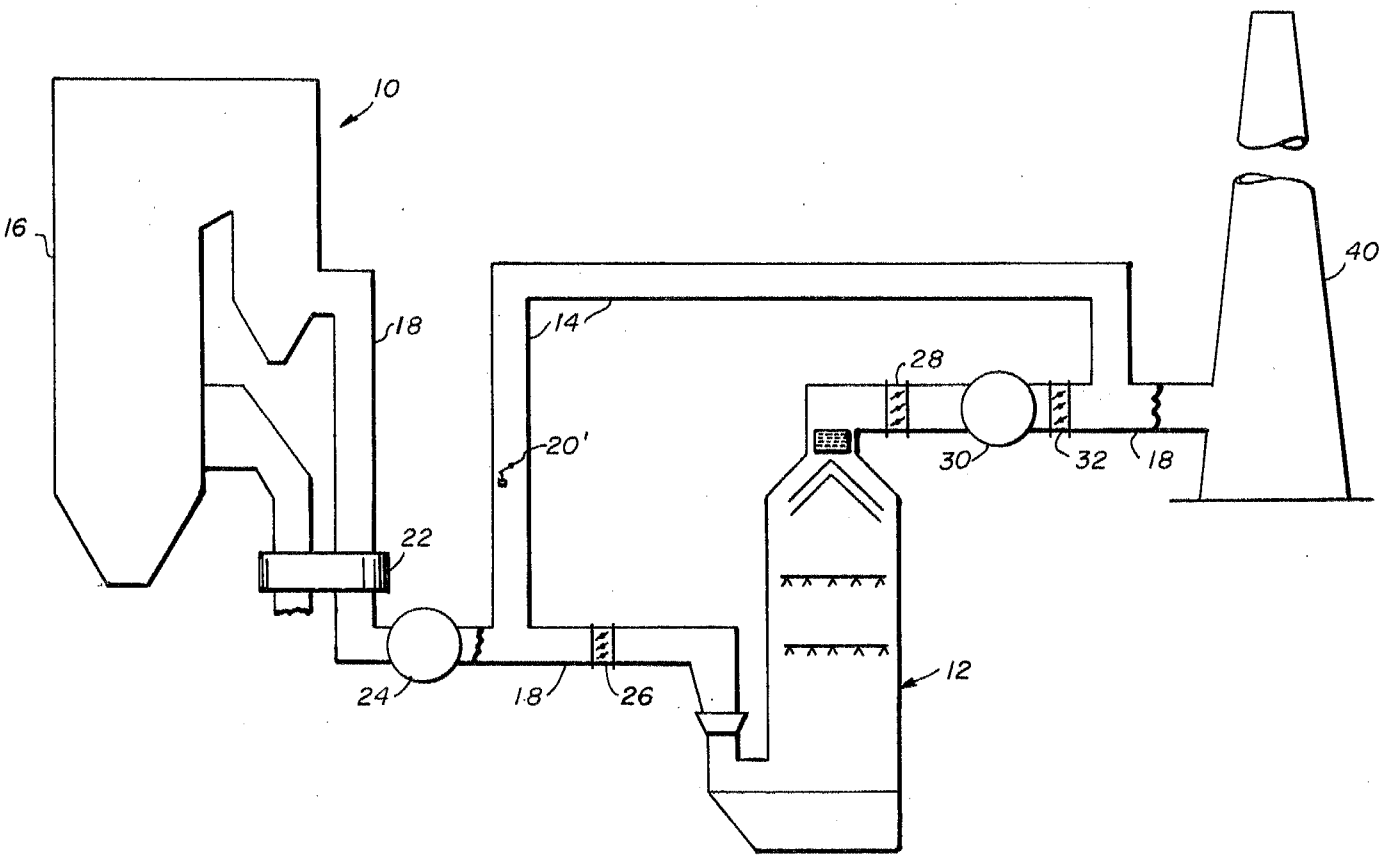
FIG. 2 is a side elevational view, partly in section, of a boiler having a gas scrubber incorporating a scrubber bypass duct designed in accordance with the present invention with the self-actuating bypass damper disposed in a vertical run of said bypass duct.

The scrubber bypass duct 14 has inlet 40 opening into the main flue 18 at a location between the induced draft fan 24 and the scrubber inlet damper 26 and an outlet 42 opening into the main flue 18 at a location between the scrubber booster fan 30 and stack 36. The flow of flue gas through scrubber bypass 14 is controlled by the self-actuating bypass damper 20 which is preferably disposed in a horizontal run as a scrubber bypass duct as shown in FIG. 1. An alternate embodiment of the invention is shown in FIG. 2, wherein the only difference is that the self-actuating scrubber bypass damper 20' is disposed in a vertical run of the scrubber bypass duct 14.

According to the invention, scrubber bypass damper 20 and 20' self-actuate in response to any pressure differential established across it. When the scrubber is in operation, the pressure rise imparted by the scrubber booster fan 30 to the flue gas flowing therethrough is modulated to balance the gas pressure in the main flue 18 at the outlet 42 of the scrubber bypass duct 14 with the gas pressure in the main flue 18 at the inlet 40 of the scrubber bypass duct 14. By design, the scrubber bypass dampers 20 and 20' will be orientated transverse to the flue gas flow through the bypass duct when there is no pressure differential across it, i.e., when the gas pressure in the main flue 18 at the outlet of the scrubber bypass duct 14 is equal to the gas pressure in the main flue 18 at the inlet 40 of the scrubber bypass duct 14. In such a position, the scrubber bypass dampers 20 and 20' will provide an essentially gas-tight barrier in the scrubber bypass thereby ensuring that all flue gas flows through the scrubber.

The need for elaborate control systems to ensure that over-pressurization of the furnace 16 does not occur when the scrubber is brought out-of-service is eliminated through the present invention by the feature that the scrubber bypass dampers 20 and 20' self-actuate in response to any pressure differential established across them. When the scrubber 12 is brought out-of-service, the scrubber booster fan 30 is shutdown and the scrubber inlet damper 26 is closed thereby shutting off flow in the main flue 18 through scrubber 12 to the stack 36. With the induced draft fan 24 still in operation and the scrubber booster fan 30 shutdown, a pressure differential is established across the scrubber bypass dampers 20 and 20'. In response to this pressure differential the scrubber bypass dampers 20 and 20' will promptly self-actuate and pivot open thereby providing a flow path to the stack 36 and precluding over-pressurization of the furnace 16.

If the pressure rise across the scrubber booster fan 30 is greater than necessary such that the gas pressure in the main flue 18 at the outlet 42 of the scrubber bypass duct 14 is greater than the gas pressure in the main flue 18 at the inlet 40 of the scrubber bypass duct 14, the scrubber bypass dampers 20 and 20' will pivot open and allow reverse flow in the scrubber bypass duct 14, i.e., a portion of the cleansed flue gas leaving the scrubber booster fan 30 will recirculate through the scrubber bypass duct 14 back to the scrubber inlet 26. Thus, as long as the pressure rise imparted to the flue gas leaving the scrubber 12 by scrubber booster fan 30 is sufficient to ensure that the gas pressure in the main flue 18 at the outlet 42 of the scrubber bypass duct 14 is equal to or greater than the gas pressure in the main flue 18 at the inlet 42 of the scrubber bypass duct 14, all of the flue gas leaving boiler 10 through the main flue 18 must pass through scrubber 12 for removal of gaseous pollutants and particulate matter before passing to the atmosphere through stack 36.

Figure 3:
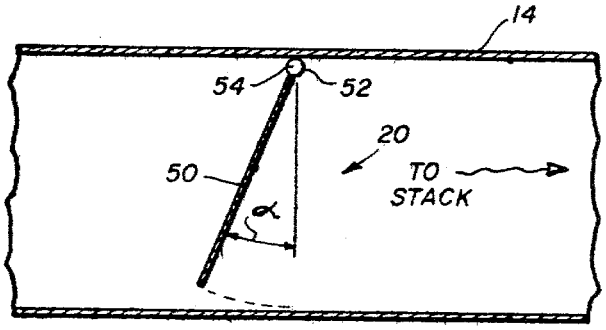
FIG. 3 is an enlarged sectional view of the self-actuating bypass damper of FIG. 1.
Figure 5:
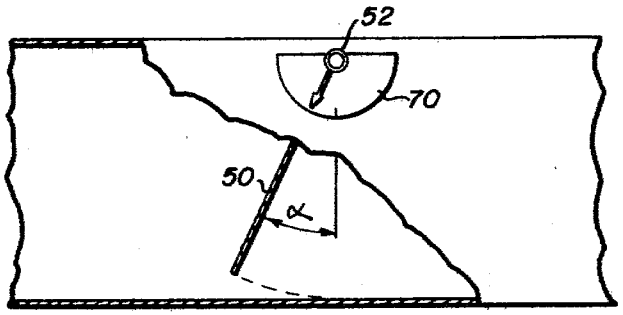
FIG. 5 is an elevational view, partly in section, of the self-actuating bypass damper of FIG. 1.

A detailed description of the scrubber bypass damper 20 can best be presented with reference to FIG. 3. The scrubber bypass damper 20, when disposed as preferred in a horizontal span of the scrubber bypass duct 14, comprises a plate 50 mounted to and suspended from a shaft 52 which is disposed across the roof of the horizontal span of the scrubber bypass duct 14 and which is free to rotate about its axis 54. Plate 50 is suitably adapted to provide an essentially gas-tight barrier when disposed vertically downward across the scrubber bypass duct 14. Operatively associated with shaft 52 are means 70 such as shown in FIG. 5 for indicating the angular displacement $\alpha$ from the vertical of the plate 50. These means may include any of the known mechanical or electrical sensors suitable for this purpose.

In operation, the plate 50 pivots about the axis of the shaft 52 in response to the resultant of the pressure forces exerted upon it by the induced draft fan 24 and the scrubber booster fan 30. The resultant pressure forces, which are proportional to the pressure differential between the gas pressure in the main flue 18 at the outlet 42 of bypass duct 14 and the gas pressure in the main flue 18 at the inlet 40 of bypass duct 14, act against the weight of plate 50 and deflect plate 50 from the vertical until the moment about the axis 54 of the shaft 52 of the resultant pressure forces acting on plate 50 and the force due to the weight of plate 50 is zero.

Since plate 50 will assume a deflected position in proportion to the pressure differential established across it, the angular displacement of plate 50 from the vertical is monitored and used to generate the required pressure differential signal input for modulating the scrubber booster fan 30 through the relationship: $\Delta P = W_p \alpha$, where $\Delta P$ is the gas pressure in the main flue 18 at the outlet 42 of the scrubber bypass duct 14 minus the gas pressure in the main flue 18 at the inlet 40 of the scrubber bypass duct 14, $W_p$ is the weight of plate 50 per square foot, and $\alpha$ is the angular displacement of plate 50. When the scrubber 12 is in operation, the scrubber booster fan 30 is adjusted to hold plate 50 in a vertical position or deflected slightly in the direction of the boiler by maintaining the gas pressure in the main flue 18 at the outlet 42 of the scrubber bypass duct 14 equal to or greater than the gas pressure in the main flue 18 at the inlet 40 of the scrubber bypass duct 14.

Figure 4:
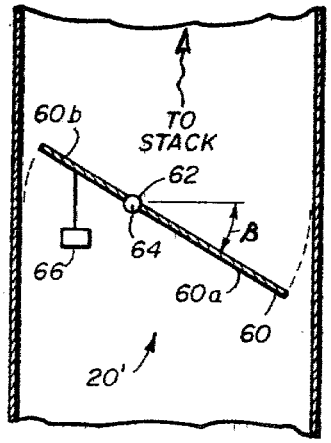
FIG. 4 is an enlarged sectional view of the self-actuating bypass damper of FIG. 2.
Figure 6:
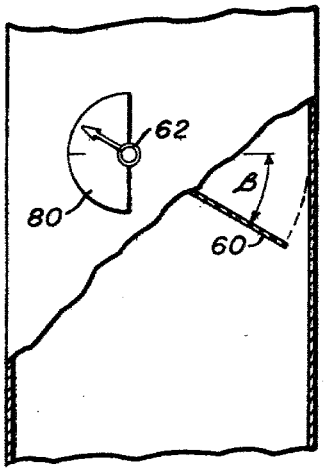
FIG. 6 is an elevational view, partly in section, of the self-actuating bypass damper of FIG. 2.

A detailed description of the scrubber bypass damper 20' can best be presented with reference to FIG. 4. The scrubber bypass damper 20', disposed in a vertical span of the scrubber bypass duct 14 comprises a counterweighted plate 60 mounted to a shaft 62 such that the shaft divides the plate 60 into two unequal leaves **60*a* and 60*b*. Shaft 62, free to rotate about its axis 64, is horizontally disposed across a vertically orientated span of the scrubber bypass duct 14 so as to define, in a horizontal plane through the shaft, a first and a second flow area on opposite sides of the shaft. Plate 60 is suitably counterweighted, for example by suspending a weight 66 from the smaller leaf 60*b* of plate 60, to ensure that it is horizontally disposed across the scrubber bypass duct 14 when the pressure differential across it is zero. The leaves 60*a* and 60*b* of plate 60 are sized to conform with the first and second flow areas and thus provide an essentially gas-tight barrier across the scrubber bypass duct 14 when plate 60 is in a horizontal position. Operatively associated with the shaft 62 are means 80 such as shown in FIG. 6 for indicating the angular displacement $\beta$ from the horizontal of the plate 60**.

In operation, plate 60 pivots about the axis of shaft 52 in response to the resultant of the pressure forces exerted upon it by the induced draft fan 24 and the scrubber booster fan 36. The resultant pressure forces, which are proportional to the pressure differential between the gas pressure in the main flue 18 and the outlet 42 of the bypass duct 14 and the gas pressure in the main flue 18 at the inlet 40 of bypass duct 14, acts against the weight of plate 60 and deflects plate 60 from the horizontal until the moment of the resultant forces about the axis 64 of shaft 62 is zero. Since plate 60 will assume a deflected position in proportion to the pressure differential established across it, the angular displacement of plate 60 from the horizontal is monitored and used to generate the required pressure differential signal input for modulating the scrubber booster fan 30 through the relationship: $\Delta P = W_p \cos\beta - 1$, where $\Delta P$ is the gas pressure in the main flue 18 at the outlet 42 of the scrubber bypass duct 14 minus the gas pressure in the main flue 18 at the inlet 40 of the scrubber bypass duct 14, $W_p$ is the weight of plate 60 per square foot, and $\beta$ is the angular displacement of plate 60 from the horizontal. When the scrubber is in operation, the scrubber booster fan 30 is adjusted to hold plate 60 in a horizontal position or deflected slightly in the direction of the boiler by maintaining the gas pressure in the main flue 18 at the outlet 42 of the scrubber bypass duct 14 equal to or greater than the gas pressure in the main flue 18 at the inlet 40 of the scrubber bypass duct 14.

What is claimed is:

1. In an apparatus having a furnace, a stack for venting combustion products formed in said furnace to the atmosphere, a main flue for conveying the combustion products away from the furnace to the stack, a first fan disposed in said main flue between the furnace and the stack, a scrubber for removing pollutants from the combustion products, the scrubber disposed in said main flue between said first fan and the stack, and means located in said main flue at the inlet of the scrubber for controlling the flow of the combustion products through the scrubber; a scrubber bypass system comprising:

a. a second fan disposed in said main flue between the scrubber and said stack;

b. means operatively associated with said second fan for modulating the pressure rise imparted to the combustion products by said second fan;

c. a bypass duct having an inlet opening into said main flue at a location between said first fan and said means for controlling the flow of the combustion products through the scrubber and an outlet opening into said main flue at a location between said second fan and the stack, said bypass duct thereby providing a flow path for passing the combustion products around the scrubber; and d. means disposed in said bypass duct for controlling the flow of combustion products through said bypass duct, said means being self-actuating in response to the pressure differential between the static pressure of the combustion products in said main flue at the inlet of said bypass duct and the static pressure of the combustion products in said main flue of the outlet of said bypass duct.

2. An apparatus as recited in claim 1 wherein said means disposed in said bypass duct for controlling the flow of combustion products through said bypass duct provides an essentially gas-tight barrier across said bypass duct when the static pressure of the combustion products in said main flue at the outlet of said bypass duct is equal to the static pressure of the combustion products in said main flue at the inlet of said bypass duct.

3. An apparatus as recited in claim 2 wherein:

a. said bypass duct has a horizontally orientated run therein; and b. said means for controlling the flow of combustion products through said bypass duct comprises:

a shaft transversely disposed across the roof of the horizontally orientated span of said bypass duct, said shaft being free to rotate about its axis; and a plate mounted to and suspended from said shaft, said plate suitably adapted to provide an essentially gas-tight barrier when disposed vertically downward across said bypass duct.

4. An apparatus as recited in claim 3 further comprising means operatively associated with said shaft for indicating the angular displacement from vertical of said plate.

5. An apparatus as recited in claim 2 wherein:

a. said bypass duct has a vertically orientated run therein; and b. said means for controlling the flow of combustion products through said bypass duct comprises:

a shaft horizontally disposed across the vertically orientated span of said bypass duct so as to define in a horizontal plate through said shaft a first and a second flow area on opposite sides of said shaft, said shaft being free to rotate about its axis; and a counterweighted plate mounted to said shaft, said plate suitably adapted to provide an essentially gas-tight barrier when disposed horizontally across said bypass duct.

6. An apparatus as recited in claim 5 further comprising means operatively associated with said shaft for indicating the angular displacement from horizontal of said counterweighted plate.

* * * * *